United States Patent [19]

Hall

[11] Patent Number: 4,762,224

[45] Date of Patent: Aug. 9, 1988

[54] MIXING CONTAINER WITH SEGREGATED INGREDIENT COMPARTMENTS

[76] Inventor: John E. Hall, 9900 Camino Royal, Merriam, Kans. 66203

[21] Appl. No.: 135,325

[22] Filed: Dec. 21, 1987

[51] Int. Cl.[4] ..... B65D 81/32

[52] U.S. Cl. ..... 206/221; 206/219; 215/DIG. 8; 220/22; 220/23; 220/254

[58] Field of Search ..... 206/219–222, 206/568; 215/DIG. 8; 220/22, 23, 254

[56] References Cited

U.S. PATENT DOCUMENTS

| | | | |
|---|---|---|---|
| 1,010,768 | 12/1911 | Isaacs | 220/23 |
| 1,668,979 | 5/1928 | Ruttan | 220/23 |
| 1,706,335 | 3/1929 | Toch | 206/221 |
| 2,120,357 | 6/1938 | Gray | 220/23 |
| 2,211,326 | 8/1940 | Gillice | 220/23 |
| 2,288,895 | 7/1942 | Fink | 220/23 |
| 2,897,994 | 8/1959 | Foss | 206/222 |
| 3,459,295 | 8/1969 | Cousar | 206/219 |

FOREIGN PATENT DOCUMENTS

| | | | |
|---|---|---|---|
| 2168026 | 6/1986 | United Kingdom | 220/22 |

*Primary Examiner*—Jimmy G. Foster

*Attorney, Agent, or Firm*—John A. Hamilton

[57] ABSTRACT

A container for facilitating the manufacture, handling, shipping and storage of products to be produced by the intermixture of a plurality of ingredients, the intermixture of which for various reasons should not be performed until a time just prior to the application of other end usage thereof. The container is provided with internal partitions dividing its interior into a plurality of compartments, in each of which one of the product ingredients is initially stored for shipping and handling. The compartments are sealed from each other to prevent premature intermixture of the ingredients. Opening of the container in a prescribed manner removes the partitions to permit intermixture of the ingredients at the desired time, that is just prior to actual usage. Means are also provided for providing access to one of the compartments without allowing intermixture of the ingredients, so that a dealer may add coloring agents before selling the container, in the event the finished product is of a type which should be available to his customer in any of a variety of colors. Means are also provided for extruding the container contents, for use when the finished product is of a paste-like consistency.

7 Claims, 1 Drawing Sheet

MIXING CONTAINER WITH SEGREGATED INGREDIENT COMPARTMENTS

This invention relates to new and useful improvements in containers in which products consisting of two or more ingredients which should not, for various reasons, be intermixed until just prior to actual use, may be conveniently packaged, handled, shipped and stored until sale to the consumer, with the ingredients segregated in separate compartments of the container. The consumer may then interconnect the compartments to permit intermixing of the ingredients just prior to actual use, keeping in mind the requirement that the product must be completely applied or otherwise used within a given time limit after the intermixture.

BACKGROUND OF THE INVENTION

There are many products which, at the time of actual use, consist of ingredients which must be intermixed just prior to use, in view of the fact that after intermixture, the mixture will, after a given time period, become unusable. For example, certain medicinal ingredients, once intermixed, will deteriorate and lose their potency after a given time period. Certain paints and enamels, such as epoxy paints, as well as adhesives, consist of ingredients which, once intermixed, will begin to harden or set up, and become unusable after a given time period. Automobile body filling compound, which at the time of use consists of a paste which may be applied to fill dents or the like in automobile bodies, and which will then harden and can then be shaped, sanded and painted, usually consists of a base material, an acrylic resin and a hardening agent which must be intermixed just prior to usage. This listing of products is by no means complete. The allowable time between intermixture and usage varies widely, ranging from perhaps eighteen hours for paints, down to perhaps one hour for body filling compound, and even much lesser times for medicinal products, each product having different time allowances. Also, certain products, particularly the paints and filling compounds in the products mentioned above, may be desired by the user to be furnished in any one of many different colors.

The above considerations create serious problems in the manufacture, sale and handling of such products. The manufacturer cannot sell the product to the dealer in an intermixed condition, since the time lapse between intermixture and usage would then in many cases amount to weeks or even months. As a result, many products are packaged and sold with the various ingredients in separate containers, which must be opened and the ingredients intermixed by the user just prior to use. This is inconvenient and time-consuming. Also, the intermixture must sometimes be made with very close and accurate control of the proportions of the ingredients, which the user may not have the skill or means to provide. The dealer usually has the facilities to add coloring pigments or agents to paints to supply any desired color, otherwise he would have to stock a prohibitively large number of different colors. However, where as in the present case the main ingredients of the product cannot be intermixed until just prior to use, means must be provided whereby the coloring agents may be added without causing intermixture of the main ingredients.

SUMMARY OF THE INVENTION

The primary object of the present invention is the provision of a container which solves all of the above enumerated problems in a simple, relatively inexpensive manner. The container, which in the embodiment selected for illustration of the principles involved, has the form of an ordinary paint can, is divided internally into two or more compartments each adapted to contain one of the ingredients of the finished product, all of the compartments being sealed from each other by partition walls connected in sealing but detachable relation to the bottom wall of the can and to the can lid, or cover. When the cover is removed, the partition walls are removed therewith, and the ingredients previously segregated in the compartments flow together and may be intermixed.

Another object is the provision of a container of the character described wherein there is provided means whereby access may be had to one of the container compartments, without removing any of the partition walls or providing any interconnection between the compartments. In this manner, a paint dealer for example may add the proper coloring agents to the can contents to provide the eventual product color his customer may desire, and then reseal the container to allow for later intermixture of the ingredients by the customer just prior to actual usage. The proportions of the ingredients may be provided in a carefully controlled factory operation by the manufacturer, so that the end user does not need to control them.

A further object is the provision of a container of the character described wherein the bottom wall of the can, while normally sealed in the can body, is movable upwardly through the length of the can to extrude the product produced by intermixture of the ingredients through openings provided therefor in the can cover. This provision is of course particularly suited for use when the finished product is pastelike in consistency, such as auto body filler.

Other objects are efficiency and dependability of operation, and simplicity and economy of construction.

With these objects in view, as well as other objects which will appear in the course of the specification, reference will be had to the accompanying drawing.

DESCRIPTION OF A PREFERRED EMBODIMENT

Figure 1:
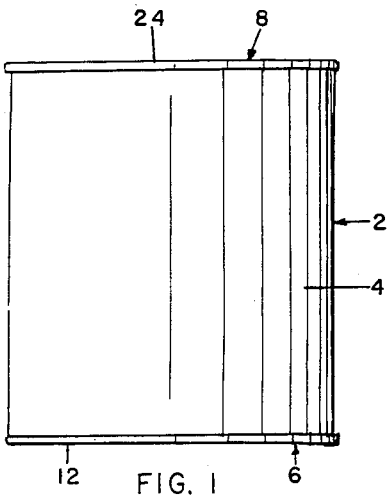
FIG. 1 is a side elevational view of a mixing container embodying the present invention.
Figure 2:
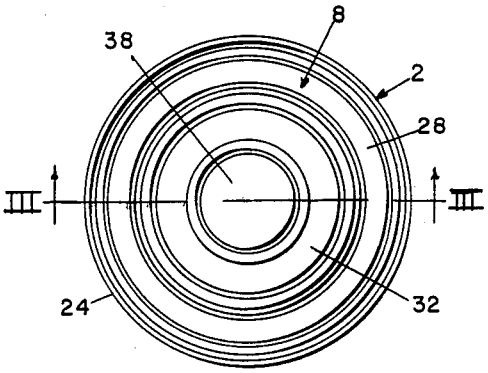
FIG. 2 is a top plan view of the container shown in FIG. 1.
Figure 3:
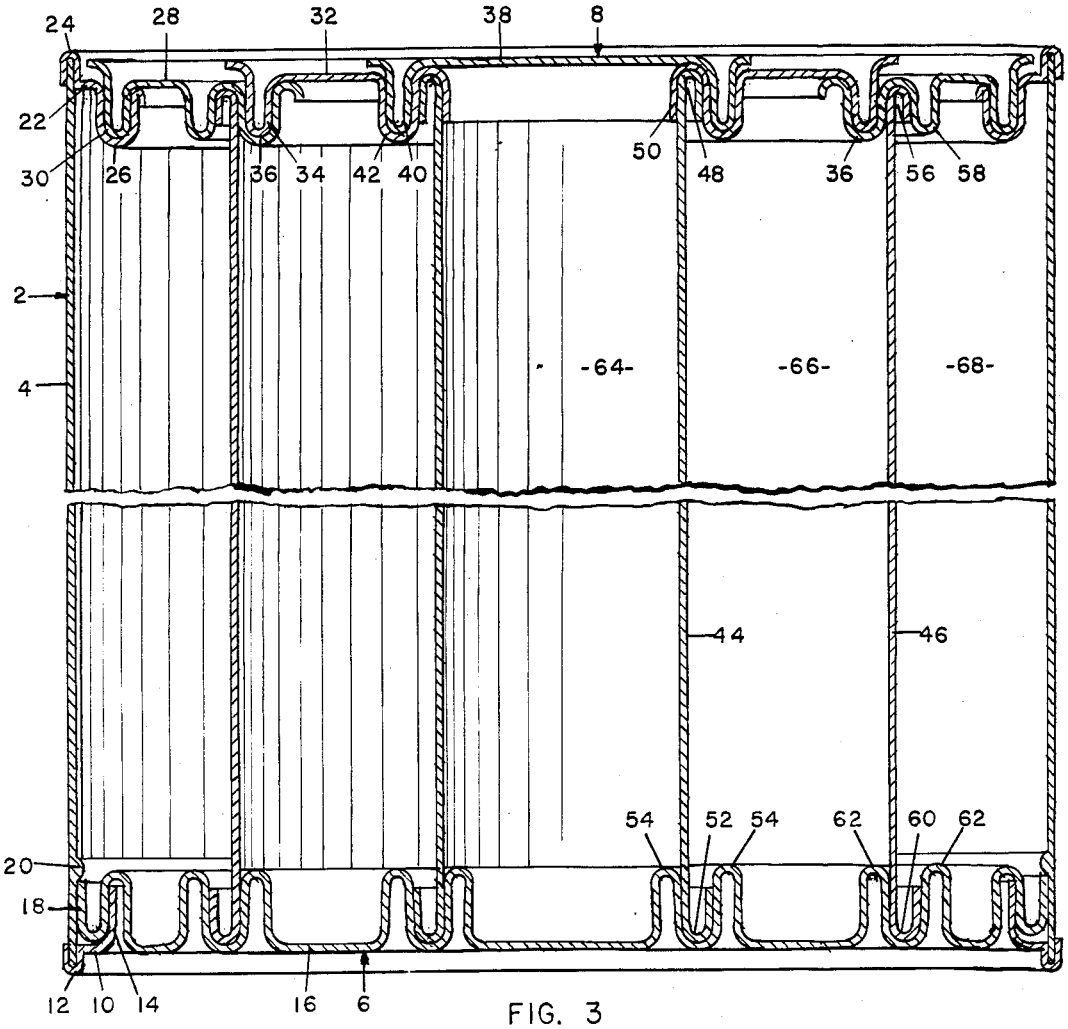
FIG. 3 is an enlarged, vertically foreshortened sectional view taken on line III—III of FIG. 2.

The form of the invention selected for illustration in the drawing is especially adapted for use with products consisting of three ingredients to be intermixed, such as auto body filling compound, although it may also be used for two-ingredient products. In the latter case, the structure may be somewhat simplified. It may be formed of sheet metal or other suitable structural materials, and may be of many different sizes and shapes. As shown, the container is indicated generally by the numeral 2. It includes a main body having an outer cylindrical wall 4 formed of sheet metal, being closed at its lower end by a bottom wall 6 and at its upper end by a cover 8. Bottom wall 6 includes a narrow annular border ring 10 having a roll seal engagement 12 around the lower edge of wall 4, and providing a cylindrical flange 14 extending upwardly into the lower portion of wall 4 concentrically therewith but spaced inwardly therefrom. The remainder 16 of the bottom wall is circular, and is provided at its periphery with a downwardly depending U-shaped rib 18 which may be pressed frictionally downwardly between flange 14 and wall 4 to form a liquid-tight seal. Rib 18 is sufficiently flexible that when pressed into place, its resilience causes it to expand to form an efficient seal. A peripheral rib 20 is formed around the inner periphery of wall 4 just above rib 18 of bottom wall 16. Rib 18 is compressed as it is pressed into engagement with flange 14, so that it may snap under rib 20, whereby the bottom wall is locked releasably in place, but it can be released for upward movement within wall 4, passing over rib 20, by tapping on the central portion 16 of the bottom wall with a hammer or the like.

Cover 8 includes a narrow annular border ring 22 having a rolled seal 24 around the upper edge of wall 4 and providing an upwardly opening annular groove 26 of slightly smaller diameter than wall 4. Cover 8 also includes an annular outer lid 28 being formed at its outer edge to present a depending rib 30 capable of being pressed downwardly into groove 26 of the border ring to form a seal, a second annular intermediate lid 32 having a depending rib 34 formed around its outer edge capable of being pressed frictionally down into a groove 36 formed in lid 28 adjacent its inner annular edge to form a seal, and a central lid 38 which is circular and which is formed to present a depending circular rib 40 around its outer edge which is capable of being pressed frictionally downwardly into a groove 42 formed in intermediate lid 32 adjacent its inner annular edge, to form a seal. Each of the lids may be pried out of engagement with the next outer lid, and outer lid 28 from border ring 22, by means of a screwdriver or the like, in the ordinary method of removing lids from paint cans. All of the seals are of the U-shaped, resilient form previously discussed in connection with rib 18 of the bottom wall, in order to form efficient, fluid-tight seals, which may nevertheless be disengaged by force applied to the joined elements in a direction parallel to the container axis.

The interior of the container is divided into sealed compartments by one or more [two shown] cylindrical tubular partition walls 44 and 46. As shown, the smaller partition wall 44 is turned on itself at its upper edge to form a U-shaped rib 48 operable to be pressed frictionally into a downwardly opening groove 50 formed in the extreme inward edge of intermediate lid 32, and is turned on itself at its lower end to form a U-shaped rib 52 adapted to be pressed frictionally downwardly into a groove formed between two upwardly extending concentric ribs 54 formed in the central portion 16 of the bottom wall. In a similar manner, the upper edge of the larger partition wall 46, which is of a diameter intermediate those of wall 4 and tube 44, is turned on itself to form a rib 56 adapted to be pressed frictionally into a groove formed between groove 36 of outer annular lid 28, and a second groove 58 also formed in outer lid 28, and is turned on itself at its lower edge to form a rib 60 adapted to be pressed frictionally between two upwardly extending concentric ribs 62 formed in the central portion 16 of bottom wall 6. Thus the interior of the container is divided into a central compartment 64, an annular compartment 66 surrounding compartment 64, and a larger annular compartment 68 surrounding compartment 66. All of said compartments are fully sealed against the removal of any of the ingredients contained therein, and against the interflow of any ingredient from any of the compartments to any other compartment. Preferably, the tubular partition walls 44 and 46 are turned back on themselves to form ribs 48 and 56 about shorter, sharper radii than they are turned to form ribs 52 and 60 at their lower ends, so that said partition walls are secured more tightly to the lid sections than to central bottom wall section 16. Thus when any lid section is pried from the container, the tubular partition section to which the lid section is connected will tend to remain tightly joined to the lid section, and to be removed therewith, for a purpose which will presently be described.

If the container is to be used for a three-ingredient product such as an auto body filler compound, a base ingredient of the compound may be placed in compartment 68, an acrylic resin in compartment 66, and a hardener ingredient in compartment 64. This filling may be accomplished after tubular partition walls 44 and 46 have been sealed into the central section 16 of the can bottom, with the composite lid assembly 28-32-38 removed from the can top. Also, the proportions of the ingredients may be closely regulated at this time in a factory operation, so that the user need not later concern himself with these proportions when he mixes the ingredients. The relative volumes of the compartments may be controlled by the proper selection of the diameters of the partition walls 44 and 46, or by specially forming said partition walls to be necked or otherwise rendered non-cylindrical to adjust the volumes of the compartments. There is no necessity that walls 44 and 46 be cylindrical, so long as they are tubular and open at both ends. Variation of the relative volumes of the ingredients may also be accomplished by filling the compartments only partially full. The composite cap 28-32-38 is then pressed into place, forming sealed engagement with border ring 22 and with the tops of tubular partition walls 44 and 46, so that all of the compartments are sealed, and the container may then be readily shipped, handled and stored with no danger that the ingredients will be prematurely intermixed. The product is normally then next handled by the dealer. At the time the dealer sells the container to a customer, he may pry central lid 38 from intermediate lid 32, and add pigments, dyes, or other coloring agents to central compartment 64. The removal of central lid 38 forms no interconnection between the compartments, and creates no danger of intermixture of the ingredients. The lid 38 may then be pressed back into place, and the container may then be handled freely by the customer. Just prior to the time the customer desires to use the product, he pries the entire lid, consisting of sections 28, 32 and 38, free from border ring 22, and lifts it free from the can. The partition walls 44 and 46 will normally lift free with the lid assembly, since the partition walls are engaged more tightly to the lid assembly than to the can bottom wall 16, as previously described. If either partition wall should not be lifted with the lid assembly, it may be lifted free from the can bottom by pulling upwardly thereon with a pair of pliers or the like. When the partition walls are thus removed, the ingredients previously segregated in all of the compartments may intermix freely. Such intermixture may be assisted by stirring the contents, or by replacing the lid assembly, without the partition walls, and placing the container in an ordinary paint can shaking machine. The finished product may then be used in the usual manner, the user of course keeping in mind the fact that it must be used within a time limit set by the nature of the product.

Many auto body filler compounds, after intermixture of their ingredients, have a more or less stiff, paste-like consistency, and may advantageously be presented for use by extruding it from the can. In the present case, such extrusion may be accomplished by placing the can on a solid surface, supported thereon by a member, such as partition wall 46, which engages only the central portion 16 of the can bottom, and pushing the can firmly downwardly so that the peripheral rib 18 of bottom section 16 is pressed upwardly out of engagement with flange 14 of bottom border ring 10, and the can bottom 16 then forced upwardly through the can outer wall 4. The contents of the can is thus extruded upwardly through the top of the can. The radius of the extruded material may be regulated by removing only central lid 38, so that extrusion is made to the diameter of that lid section, by additionally removing annular lid section 32 so that the extrusion has the diameter of the opening of that lid section, or by removing lid section 28, so that the extrusion has the diameter of the opening for that lid section.

The container as shown may also be used for two-ingredient products such as epoxy paints or the like. In that case, one of the tubular partition walls, say wall 46, is simply not used, with a base paint ingredient being placed in the space previously occupied by compartments 66 and 68, and an epoxy resin being contained in compartment 64. The dealer may still remove central lid 38 temporarily to add pigment or coloring agents to compartment 64, but the two annular lids 28 and 32 then function as a single lid, and would ordinarily never be separated. Actually, when originally manufactured for use with a two-ingredient product, the container may be somewhat simplified. Not only may tubular partition wall 46 be eliminated, but also the means for sealing its upper and lower ends respectively to the lid assembly and to the can bottom. Also, the two annular lids 28 and 32 may be combined to form a single lid, and can bottom 10-16 could be unitary and permanently affixed to close the bottom of outer can wall 4.

While I have shown and described a specific embodiment of my invention, it will be readily apparent that many minor changes of structure and operation could be made without departing from the spirit of the invention.

I claim:

1. A container for segregating two or more ingredients which when intermixed form a finished product, but which should not be intermixed until just prior to actual usage of the finished product, said container comprising:

a. a hollow container body having a top and a bottom, b. a bottom wall sealing the bottom of said body, c. a composite lid assembly closing the top of said body and comprising a central lid and at least one annular lid surrounding said central lid, d. means providing sealing engagement between said central lid and the inner edge of the innermost of said annular lids, between the outer edge of said innermost annular lid and the inner edge of the next outer annular lid, and the outer edge of the outermost annular lid and the top edge of said body, said sealing connections being manually engageable and disengageable, e. one or more tubular partition walls disposed within said body and extending between said bottom wall and said composite lid assembly, and being of successively smaller diameters than said body to divide said body into compartments for containing said ingredients, f. means providing manually engageable and disengageable sealing engagement between the top of each of said tubular partition walls and one of the said annular lids, but not with said central lid, and g. means providing manually engageable and disengageable sealing engagement between the bottom of each of said tubular partition walls and said bottom wall, said sealing engagements between each of said partition walls and said annular lids and said bottom wall being engageable and disengageable by force applied thereto in a direction parallel to the axes of said tubular partition walls.

2. A container as recited in claim 1 including at least two of said annular lids surrounding said central lid, and a number of said tubular partitions equal to the number of said annular lids, each of said partition walls having sealing engagement at its top with a corresponding annular lid.

3. A container as recited in claim 1 including only one of said annular lids surrounding said central lid, and only one of said tubular partition walls, said partition wall having sealing engagement at its top with said single annular lid.

4. A container as recited in claim 1 wherein said sealing means joining each of said lid sections to the next outer lid section, and the outermost lid section to said container body, comprises a depending rib of U-shaped cross-sectional contour formed in the peripheral outer edges of said central lid section and each of said annular lid sections, and an upwardly opening groove of U-shaped cross-sectional contour formed around the inner peripheral edge of each of said annular lid sections and around the top edge of said container body, each of said ribs being positioned to enter a corresponding groove as said composite lid assembly is pressed downwardly into place, said ribs and grooves being formed of resilient sheet metal and so proportioned that as each rib enters its corresponding groove, the rib and groove are resiliently deformed to provide a tight frictional engagement for a more efficient sealing action.

5. A container as recited in claim 1 wherein said sealing means joining the upper and lower ends of each of said tubular partition walls respectively to one of said annular lids and to said bottom wall comprises:

a. an upwardly directed rib of U-shaped cross-sectional contour formed peripherally around the upper edge of each of said tubular partition walls, b. a downwardly directed rib of U-shaped cross-sectional contour formed peripherally around the bottom edge of each of said tubular partition walls, c. a downwardly opening circular groove of U-shaped cross-sectional contour formed in each of said annular lid sections corresponding to the top of one of said tubular partition walls, and d. an upwardly opening circular groove of U-shaped cross-sectional contour formed in said bottom wall, said lid and bottom wall grooves being positioned to receive the top and bottom ribs of said partition walls frictionally therein as said lid assembly is pressed downwardly into place.

6. A container as recited in claim 1 wherein the bottom wall of said container body is movable upwardly through said container body, whereby to extrude the contents of said container body upwardly through a top opening of said container body formed by removal of some or all of the sections of said composite lid assembly, when the contents of said container body are of a paste-like consistency.

7. A container as recited in claim 6 wherein said bottom wall of said container body is normally sealed in said container body by means including:

a. a border ring sealed around its periphery in said container body and being annular in form, providing at its inner edge a peripheral flange projecting upwardly into said container body in parallel, spaced apart relation to the body wall, and b. a circular wall adapted to fill the opening of said border ring, and being formed to present a depending peripheral rib adapted to be pressed frictionally downwardly between said flange and the wall of said container body.

* * * * *